United States Patent [19]

Crabtree

[11] 3,936,982

[45] Feb. 10, 1976

[54] SHARPENING STONE FOR DEHORNERS

[75] Inventor: Delbert M. Crabtree, Stanford, Mont.

[73] Assignee: Margaret Sisson, Lewistown, Mont. ; a part interest

[22] Filed: Nov. 21, 1974

[21] Appl. No.: 526,047

[52] U.S. Cl. ..... 51/211 R

[51] Int. Cl.[2] ..... B24D 15/00

[58] Field of Search..... 51/211 R, 214, 204, 205 R, 51/205 WG, 206 R, 209 R, 168, 207

[56] References Cited

UNITED STATES PATENTS

| | | | |
|---|---|---|---|
| 104,732 | 6/1870 | Haynes | 51/211 R |
| 502,932 | 8/1893 | Parsells | 51/204 |
| 951,956 | 3/1910 | Martin | 51/211 R |
| 3,721,391 | 3/1973 | Lepola | 51/206 R X |
| 3,802,130 | 4/1974 | Lindenbeck | 51/207 |

*Primary Examiner*—Donald G. Kelly
*Attorney, Agent, or Firm*—Clarence A. O'Brien; Harvey B. Jacobson

[57] ABSTRACT

A generally rectangular three dimensional body is provided constructed of two superimposed layers of abrasive material. The layers of abrasive material have different abrasive properties and the body is provided with three parallel bores extending through the two layers of the body and spaced longitudinally therealong. The bores are approximately ⅛ inch, ⅞ inch and ¾ inch in diameter and the opposite ends of the bores open through parallel planar remote surfaces of the two layers of the body and are provided with inwardly tapering conical counterbores. The body of abrasive material may therefore be utilized to sharpen the beveled ends of cylindrical cutting members such as dehorners utilized to dehorn calves at branding time.

2 Claims, 3 Drawing Figures

SHARPENING STONE FOR DEHORNERS

BACKGROUND OF THE INVENTION

When calves are branded the usual practice is to dehorn them at the same time they are restrained for branding purposes. The tools used in dehorning calves comprise hollow cylindrical bodies having handle portions on one end and beveled sharpened edges at the other end. These tools have their sharpened ends telescoped over the beginning horns of calves and are utilized to cut the horns from the calf, the intermediate portions of the cylindrical cutters spaced between their opposite ends being provided with enlarged windows or discharge openings for the horns which are removed.

When horns are to be cut from calves a cutter of a size only so large as is necessary to snugly telescope over the base end of the horn is utilized. Accordingly, dehorning tools are conventionally constructed of 1 inch diameter, ⅞ inch in diameter and ¾ inch in diameter to ensure that a dehorning tool only so large as is necessary may be used.

After a dehorning tool is used several times the beveled cutting edge thereof becomes dull and renders the dehorning process more difficult and time cosuming. Accordingly, it is necessary to frequently re-sharpen the beveled cutting edge of dehorning tools. However, conventional methods of sharpening dehorning tools include grinding wheels, files and conventional Carborundum stones. With these types of sharpening tools the re-sharpening of dehorning tools becomes a time consuming task.

Examples of sharpening devices including some of the general features of the instant invention may be found in U.S. Pat. Nos. 104,732, 466,077, 502,932 and 905,638.

SUMMARY OF THE INVENTION

The sharpening stone of the instant invention is in the form of a conventional Carborundum stone including superposed plies of Carborundum stone of different grades. However, the stone is provided with three bores formed therethrough at points spaced therealong with the opposite ends of the bores opening through the remote sides of the two plies of the stone and being provided with conical inwardly tapering counterbores. The angle of the counterbores is comparable to the desired bevel on the cutting end of a cylindrical dehorning tool and the diameters of the bores are 1 inch, ⅞ inch and ¾ inch, corresponding directly to the inside diameters of the three most common sizes of dehorning tools.

The main object of this invention is to provide a sharpening stone for dehorning tools which may be utilized in conjunction with the three basic sizes of dehorning tools in order to rapidly sharpen the beveled cutting ends thereof with little effort.

Another object of this invention, in accordance with the immediately preceding object, is to provide a sharpening stone in accordance with the preceding objects and including opposite side portions thereof having different abrasive characteristics.

Yet another object of this invention is to provide a dehorning tool sharpening stone which may be also utilized to sharpen other instruments which may require sharpening.

A final object of this invention to be specifically enumerated herein is to provide a dehorning tool sharpening stone in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
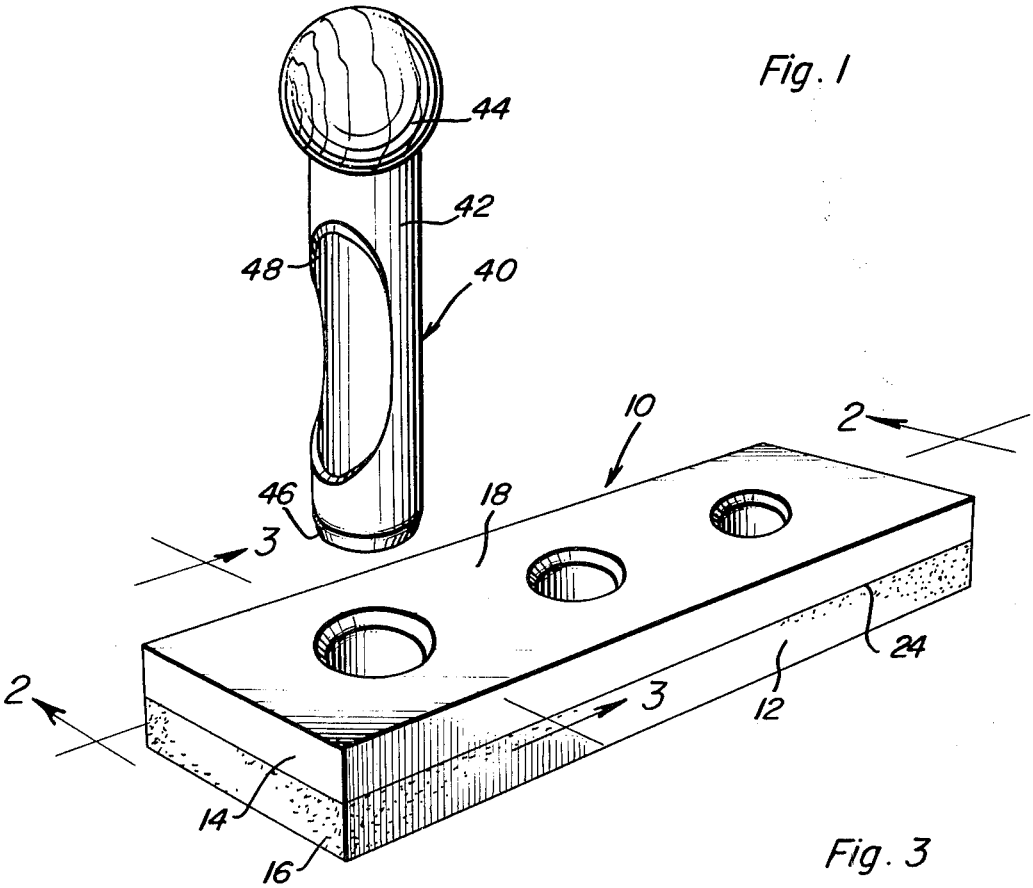
FIG. 1 is a perspective view of the dehorning tool sharpening stone of the instant invention with a dehorning tool to be sharpened illsutrated in displaced position relative to the sharpening stone ready for engagement with the latter.
Figure 3:
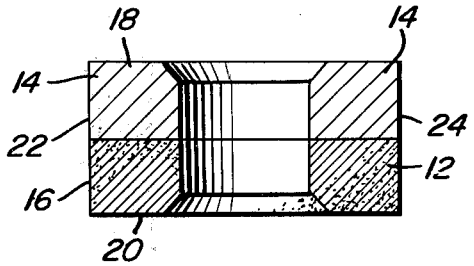
FIG. 3 is an enlarged transverse vertical sectional view taken substantially upon the plane indicated by the section line 3—3 of FIG. 1.
Figure 2:
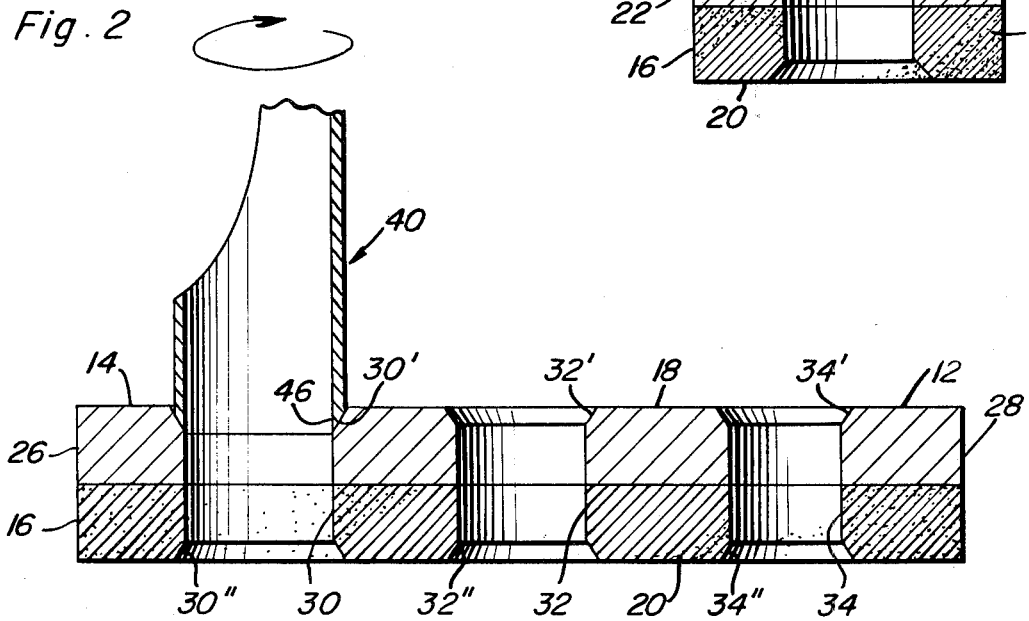
FIG. 2 is an enlarged longitudinal vertical sectional view taken substantially upon the plane indicated by the section line 2—2 of FIG. 1 and with the shaprened end of a dehorning tool engaged with the sharpening stone.

Referring now more specifically to the drawings, the numeral 10 generally designates the sharpening stone of the instant invention. The stone 10 includes a substantially rectangular three dimensional body 12 constructed of a pair of plies 14 and 16 secured together in superposed relation. The body 12 includes upper and lower surfaces 18 and 20, opposite side surfaces 22 and 24 and opposite end surfaces 26 and 28.

Three upstanding bores 30, 32 and 34 are formed through the body 12 at points spaced along the longitudinal centerline thereof and the opposite ends of the bores 30, 32 and 34 open through the upper and lower or top and bottom surfaces 18 and 20 of the body 12. The upper ends of the bores 30, 32 and 34 are beveled as at 30′, 32′ and 34′ and the lower ends of the bores are beveled as at 30″, 32″ and 34″. The beveled surfaces 30′, 32′ and 34′ define inwardly tapering counterbores and the beveled surfaces 30″, 32″ and 34″ define corresponding inwardly tapering counterbores formed in the lower ends of the bores 30, 32 and 34.

The bore 30 is 1 inch in diameter, the bore 32 is ⅞ inch in diameter and the bore 34 is ¾ inch in diameter.

The plies 14 and 16 of the body 12 are formed of fine and coarse Carborundum which consists of an abrasive of silicon carbide.

As may be seen in FIGS. 1. and 2 of the drawings, the numeral 40 generally designates a dehorning tool. The tool 40 includes a cylindrical body 42 provided with a knob-shaped handle 44 on one end and open at its other end. The open other end of the body 42 includes an outer taper 46 whereby the open end of the body 42 is sharpened. In addition, the body 42 also includes an enlarged window or port 48 centrally intermediate its opposite ends defining a discharge port for horns removed by the tool 40.

When the beveled cutting edge 46 of the body 42 is to be sharpened, the tool 40 is first engaged in the end of the bore of the corresponding size formed in the body 12 opening through the outer surface of the course ply 16. Then, with the longitudinal axis of the tubular body 42 disposed substantially normal to the adjacent surface 20 of the body 12, the tool 40 is oscillated about its longitudinal axis to renew the bevel 46. Then, when the bevel 46 has been renewed by the rough or coarse Carborundum ply 16, the beveled end 46 of the tool 40 is engaged in the opposite end of the bore opening through the surface 18 of the ply 26 and again oscillated about its longitudinal axis in order to complete the sharpening operation.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A sharpening stone for sharpening dehorners, said stone comprising an elongated body defined by a pair of elongated superposed plies of rigid abrasive materials graded as fine and coarse abrasives, the remote surfaces of said plies being substantially planar and parallel, said body having a plurality of longitudinally spaced bores of different diameters formed therethrough with the opposite ends of said bores opening through said remote surfaces, said opposite ends of said bores including inwardly tapering counterbores.

2. The combination of claim 1 wherein said remote surfaces are sufficiently wider than the maximum diameters of the counterbores opening therethrough to define grinding surfaces upon which various blade-type tools may be sharpened.

* * * * *